US005956776A

United States Patent [19]

Chartrand

[11] Patent Number: 5,956,776

[45] Date of Patent: Sep. 28, 1999

[54] ADJUSTABLE HELMET HAVING AN IMPROVED LOCKING MECHANISM

[75] Inventor: Daniel Chartrand, Deux-Montagnes, Canada

[73] Assignee: Bauer Inc., Montreal, Canada

[21] Appl. No.: 08/980,312

[22] Filed: Nov. 28, 1997

[51] Int. Cl.[6] ..... A42B 3/22

[52] U.S. Cl. ..... 2/420; 2/425; 2/424

[58] Field of Search ..... 2/6.1, 6.3, 6.5, 2/410, 417, 418, 420, 424, 425, 6.7

[56] References Cited

U.S. PATENT DOCUMENTS 4,539,715 9/1985 Clement ..... 2/420

FOREIGN PATENT DOCUMENTS 1116801 1/1982 Canada .

0 150 876 8/1985 European Pat. Off. .

0 279 086 8/1988 European Pat. Off. .

3232762 A1 4/1983 Germany .

*Primary Examiner*—Diana L. Oleksa

*Attorney, Agent, or Firm*—Finnegan, Henderson, Farabow, Garrett & Dunner, L.L.P.

[57] ABSTRACT

The invention relates to an adjustable helmet having a front shell and a back shell that are movably secured to one another and that comprise engaging members that may be held together by a locking mechanism comprising a cam that pivots about an axis extending in a direction that is substantially parallel to a side portion of the helmet. The locking mechanism of the present invention has the advantage of exerting a compressive force on a substantial portion of the engaging members thereby providing a more solid engagement. The locking mechanism also has the advantage of being easily replaceable by a conventional mounting screw assembly. The helmet of the present invention is particularly well suited for use in hockey or other like sports.

11 Claims, 4 Drawing Sheets

ADJUSTABLE HELMET HAVING AN IMPROVED LOCKING MECHANISM

FIELD OF THE INVENTION

The present invention relates to an adjustable helmet and more particularly, to an adjustable helmet comprising an improved locking mechanism that extends longitudinally and that preferably allows a rear shell to move angularly relative a front shell.

BACKGROUND OF THE INVENTION

Helmets comprising adjustability features are known. In this regard, it Is known to provide an adjustable helmet having two shell portions that are held tog ether by screws. The loosening and tightening of the screws allow for the adjustment of the helmet. Such adjustment means however require the use of tools such as screwdrivers or the like and are therefore impractical. Furthermore, they do not allow one to readily adjust a helmet while wearing it. The initial adjustment thus has to be approximate and proper fit is achieved on a trial and error basis.

Efforts have thus been made to improve the conventional adjustable helmet by implementing therein an adjustment mechanism that does not require any tools. An example of such mechanism is found in U.S. Pat. No. 4,539,715 issued on Sep. 10, 1985 and assigned to the present applicant. The adjustable helmet described in that patent, which is commercially available under the trademark COOPER XL7, comprises two shell portions with mating surfaces having teeth that overlap and engage with one another to retain the shell portions in a given overlapping position. The mating surfaces are held in engagement by a locking mechanism that comprises a cam member and a bracket having extending tabs comprising sockets into which extend pins fixed to the cam member, the tabs defining the axis of swivel of the cam member. When the bracket and cam member are in a locking position, they cooperate to retain the mating surfaces in an overlapping relationship. When they are in an adjustment position, the mating surfaces may move relative one another since the tabs are slidingly moveable within longitudinal slots to allow for the adjustment of the helmet.

The adjustment mechanism provided for in U.S. Pat. No. 4,539,715 possesses however various limitations which negatively affect its performance. First, the axis of swivel of the cam member is generally perpendicular relative to the side portions of the helmet and is generally parallel to the teeth. Therefore, the orientation of the cam member relative to the teeth is such that the cam member fails to apply a compressive force along a significant number of the teeth. This reduces the compressive force exerted on the teeth and allows the shell portions to disengage and move relative one another during a severe impact, such as when a hockey player hits the board, even when the adjustment mechanism is in a "locked" position. Also, because of the generally rectangular cross-sectional shape of the bracket's extending tabs and of the corresponding longitudinal slots, the locking mechanism of this patent only allows for an adjustment in a direction that is perpendicular to the axis of swivel of the cam member. In other words, the back shell is only moveable in a forward-rearward direction relative to the front shell. This is impractical since it has been discovered that better adjustment may be provided when the back shell moves angularly relative to the front shell.

Another disadvantage is that the generally rectangular cross-sectional shape of the tabs and longitudinal slots does not allow one to easily replace the locking mechanism by conventional mounting screws.

OBJECTS AND STATEMENT OF THE INVENTION

It is therefore an object of the present invention to provide an adjustable helmet having an improved locking mechanism overcoming some of the disadvantages of the prior art and that exerts a sufficient compressive force to prevent disengagement during an impact and wherein this force is applied along a direction that is not parallel to the direction of the teeth.

It is a further object of the invention to provide an adjustable helmet in which the back shell may move angularly relative to the front shell.

It is yet a further object of the invention to provide an adjustable helmet with a locking mechanism that can be replaced with a conventional locking mechanism such as screws.

As embodied and broadly described herein, the invention provides an adjustable helmet comprising a front shell and a back shell moveable relative to one another, each of the front and back shells comprising a plurality of engaging members to allow the front shell to be secured to the back shell in a selected position, said helmet further comprising a locking mechanism having a cam being pivotable about a pivot axis to acquire either one of a locking position and an adjustment position, in said locking position, said cam exerting a force on said engaging members of either ones of said front and back shells so that they interact with corresponding engaging members of either ones of said front and back shells to secure said front and back shells in a selected position, and in said adjustment position, said cam being pivoted about said axis so as to allow said front shell to move relative to said back shell, said axis being defined by the projecting arms of a clevis member, said arms extending through longitudinal slots located on either ones of said front and back shells, said arms being pivotally connected to the cam, wherein said pivot axis of said locking mechanism extends in a direction that is substantially parallel to a side portion of said helmet.

In a preferred embodiment, the longitudinal slots extend upwardly and rearwardly from the front shell, whereby the front and back shells move angularly relative to one another.

Preferably, the arms of the clevis member have a generally-circular cross section, the cam and the arms of the clevis member comprises openings therethrough and the cam is pivotally connected to the arms by a removable locking pin. Alternatively, the arms may comprise sockets and the cam may comprise pins extending through the sockets thereby pivotally connecting the cam to the arms.

In another preferred embodiment, the engaging members consist of parallelly extending teeth and the can comprises an integral lever for pivoting it. Most preferably, the side portion of the front shell comprises a recessed area receiving the locking mechanism, whereby the integral lever does not project substantially outwardly from the surface of the side portion. Preferably, a locking mechanism is provided on each side of the helmet.

All the objects of the invention are thus met by providing an adjustable helmet comprising a locking mechanism which acts in a direction that is not parallel to the direction of the engaging members. In the preferred embodiment, the locking mechanism thus comprises a cam being pivotally connected to the projecting arms of a clevis member, the cam is pivotable about an axis defined by these projecting arms to acquire either one of a locking position and an adjustment position. The shape and size of the cam is such that, when it is rotated towards a locking position, the cooperation between the cam and the clevis member exerts a compressive force on the engaging members of the front shell and the back shell so that they interact with one another to secure the front and back shells in a selected position.

In contrast with the locking mechanism of the prior art, the locking mechanism of the present invention exerts a compressive force on a significant number of teeth thereby providing a more secure locking engagement between the front and back shells. This optimal configuration is achieved by having an axis of rotation that extends in a direction that is substantially parallel to the side portions of the front shell of the helmet.

Other objects and features of the invention will become apparent by reference to the following specification and to the drawings.

BRIEF DESCRIPTION OF THE DRAWINGS

The following is a description by way of a preferred embodiment, reference being made to the following drawings, in which.

DESCRIPTION OF THE PREFERRED EMBODIMENT

Figure 1:
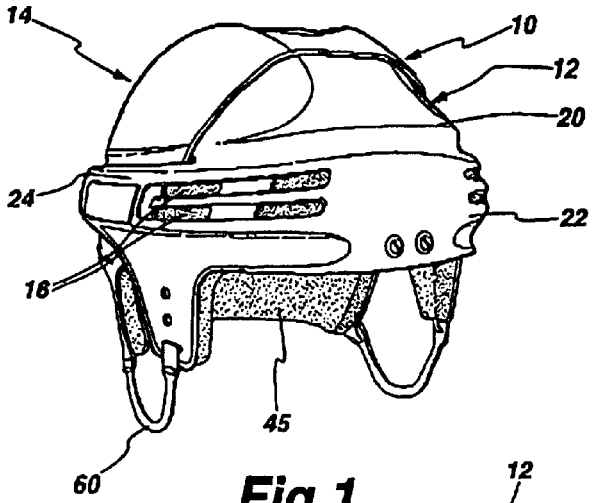
FIG. 1 is a perspective view of an adjustable helmet incorporating a locking mechanism made in accordance with the present invention.
Figure 5:
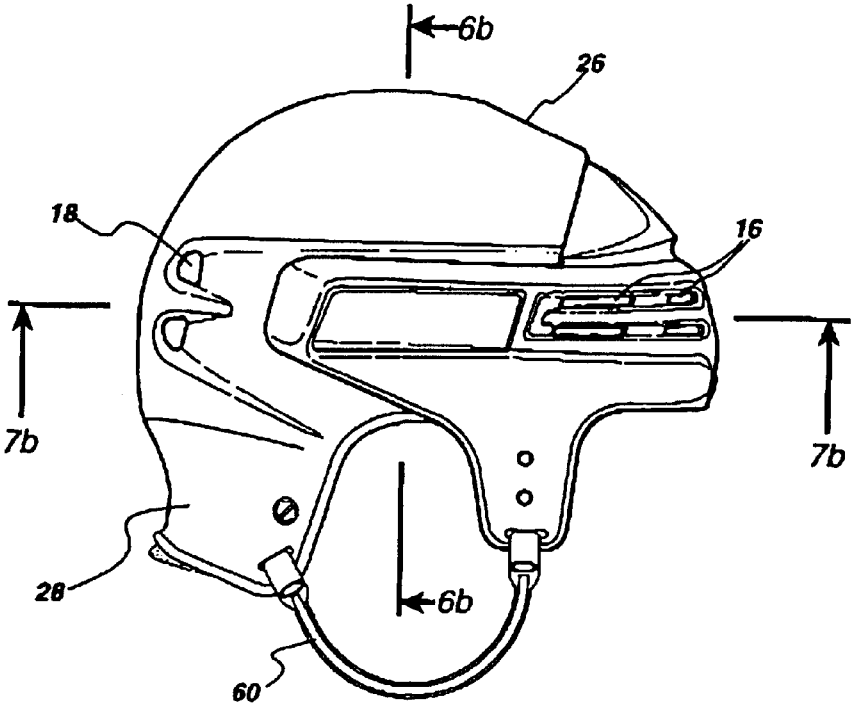
FIG. 5 is a side elevational view of the adjustable helmet showing the locking mechanism in a locking position.

Referring now to FIG. 1, there is shown an adjustable helmet generally referred to as 10 and comprising a front shell 12 (sometimes referred to as a visor) and a back shell 14 (sometimes referred to as a crown), the front and back shells being angularly moveable relative one another as described hereinafter. The front shell comprises a top wall portion 20 and a front visor portion 22 that extends into side portions 24. Similarly, the back shell comprises a top wall portion 26 and side portions 28. As shown sore particularly in FIGS. 1 and 5, when the front and back shells engage one another, the top wall portion 20 of the front shell 12 is located underneath the top wall portion 26 of the back shell 14 while the side portions 24 of the front shell 12 are located over the side portions 28 of the back shell 14.

The front and rear shells are made of suitable impact resistant plastics materials such as polyethylene and may comprise openings 16 and 18 to provide for adequate ventilation. The helmet 10 also comprises an inner liner 45 and may comprise ear straps 60 such as the ones conventionally found in the art.

Figure 7A:
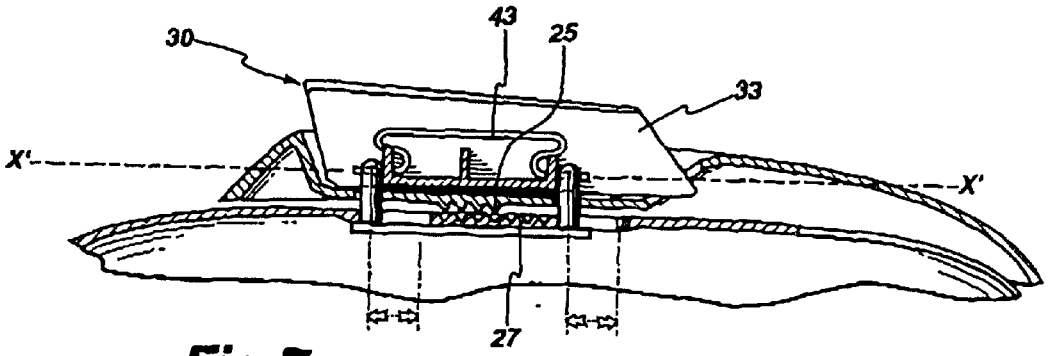
FIG. 7*a* is a partial cross-sectional view taken along lines 7*a*—7*a* in FIG. 4, showing the mating surfaces of the shell while the locking mechanism is in an adjustment position.
Figure 7B:
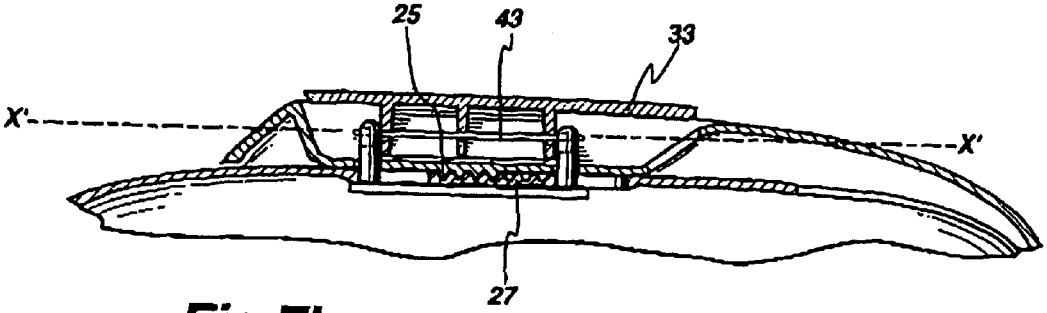
FIG. 7*b* is a partial cross-sectional view taken along lines 7*b*—7*b* in FIG. 5, showing the mating surfaces of the shell while the locking mechanism is in a locking position.

As shown more particularly in FIGS. 7*a* and 7*b*, the overlapping portions of the front shell 12 and the back shell 14 comprise a plurality of engaging members 25 and 27 that will allow the front shell to be secured to the back shell in a selected position. More preferably, the engaging members consist of parallelly extending teeth that cooperate with one another to prevent longitudinal displacement of the shells 12 and 14 relative one another when the helmet is in a locked position. The person skilled in the art will however realize that other types of mechanical linkages could be used as engaging members such as a tongue and groove joint or splines. Electromagnetic linkages, such as magnets, could also conceivably be used.

The front shell 12 and the back shell 14 are movably secured to one another by the use of a locking mechanism generally referred to as 30.

Figure 2:
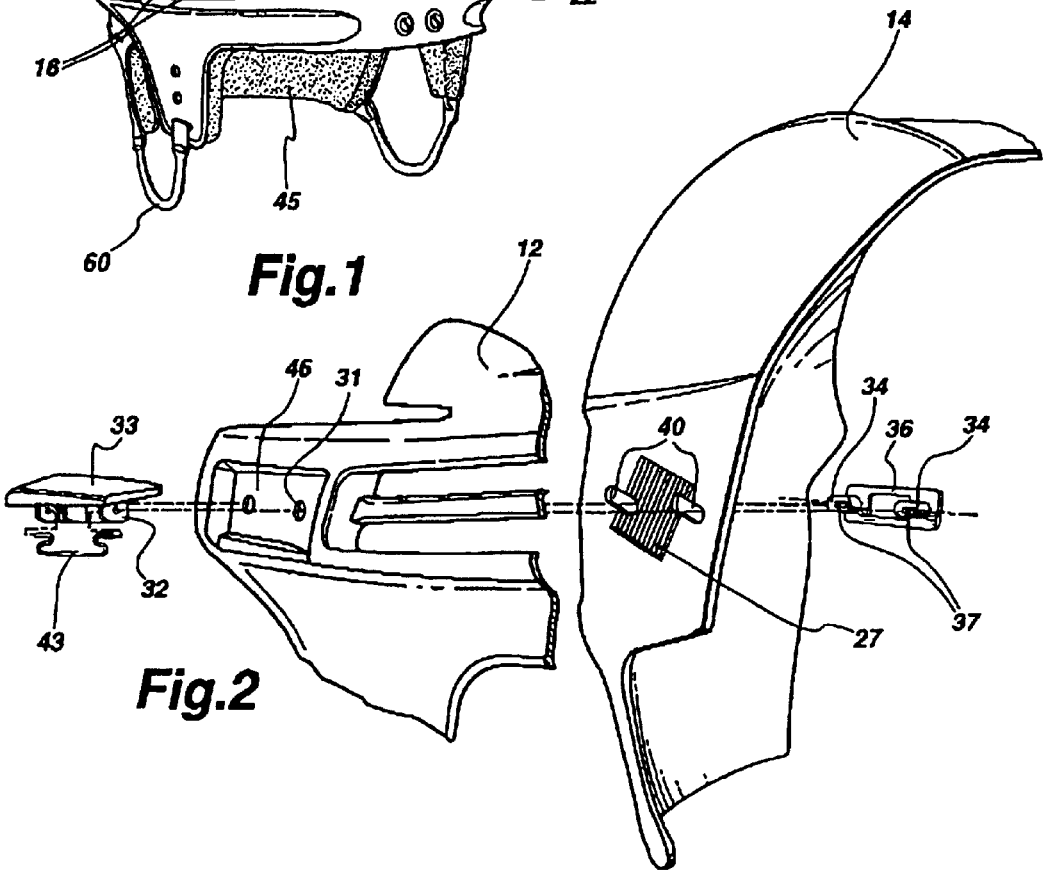
FIG. 2 is a partial exploded perspective view of the locking mechanism as incorporated into the adjustable helmet.
Figure 6A:
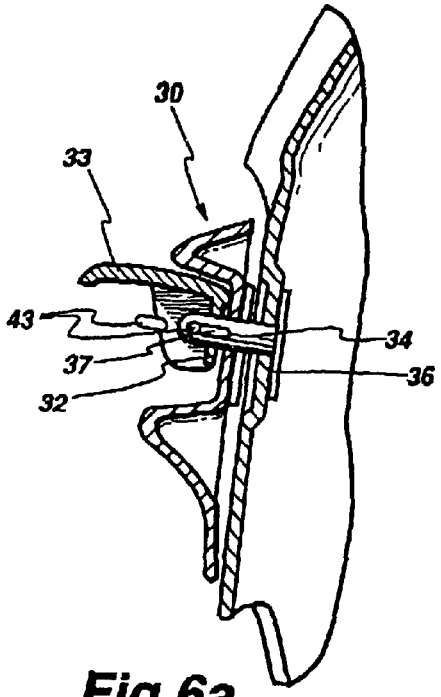
FIG. 6*a* is a partial cross-sectional view taken along lines 6*a*—6*a* in FIG. 4, showing the locking mechanism in an adjustment position.
Figure 6B:
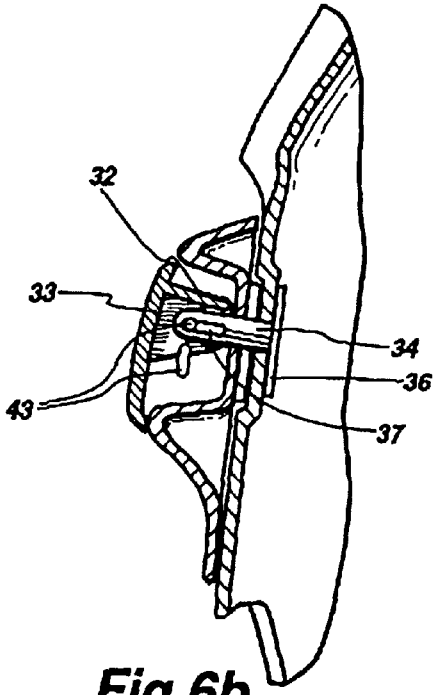
FIG. 6*b* is a partial cross-sectional view taken along lines 6*b*—6*b* in FIG. 5, showing the locking mechanism in a locking position.

As shown in FIG. 2, the locking mechanism comprises a cam 32 having an integral lever 33, the cam 32 being pivotally connected to the projecting arms 34 of a clevis member 36. As shown more particularly in FIGS. 6*a*, 6*b* and 7*a*, 7*b*, the cam 32 is pivotable about the axis X' defined by the projecting arms 34 to acquire either one of a locking position (FIG. 6*b*) and an adjustment position (FIG. 6*a*). Thus, as shown in FIGS. 6*a* and 6*b*, and 7*a* and 7*b*, the shape and size of the cam 32 is such that, when it is rotated towards the locking position, as shown in FIGS. 6*b* and 7*b*, the cooperation between the cam and the clevis member 36 exerts a compressive force on the engaging members 25 and 27 of the front shell 12 and the back shell 14, so that they interact with one another to secure the front and back shells in a selected position.

As shown more particularly in FIG. 7*b* and contrary to the locking mechanism of the prior art, the locking mechanism of the present invention exerts a compressive force on a significant number of teeth thereby providing a more secure locking engagement between the front and back shells. This optimal configuration is achieved by having an axis of rotation X' that extends in a direction that is substantially parallel to the side portions 24 of the front shell.

Figure 3:
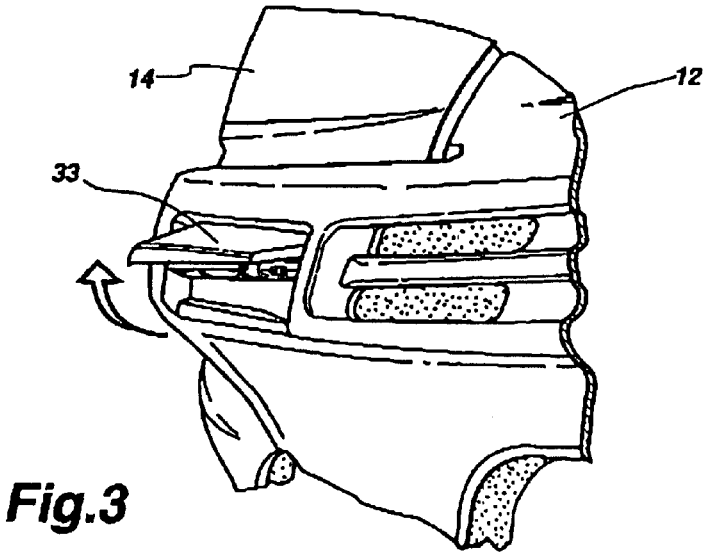
FIG. 3 is a partial perspective view of the adjustable helmet wherein the locking mechanism is in an adjustment position.

When the user desires to adjust the helmet, he or she simply rotates the lever 33 from bottom to top as shown in FIG. 3. As shown in more details in FIGS. 6*a* and 7*a*, the cam member 32 thus rotates into a position in which the engaging members of the front and back shells are released from engagement thereby permitting the shells to move relative one another.

Figure 4:
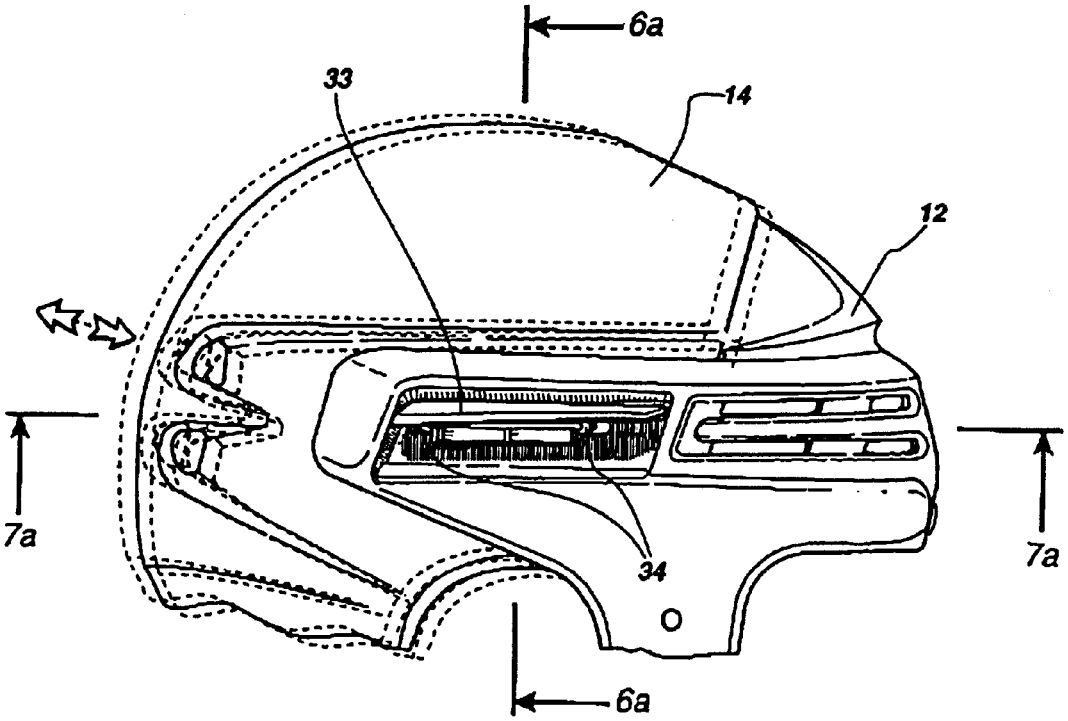
FIG. 4 is a side elevational view of the adjustable helmet illustrating the angular movement of the back shell relative to the front shell.

Referring now to FIG. 2, in order to allow for the angular displacement of the back shell relative the front shell, the front shell 12 comprises openings 31 and the back shell comprises longitudinal slots 40, through which extend the arms 34 of the clevis member 36. The longitudinal slots 40 extend upwardly and rearwardly from the side portions thereby allowing for the angular movement of the shells relative one another as shown in FIG. 4. In the preferred embodiment, the angle of the longitudinal slots is approximately 40° as measured from the horizontal. The person skilled in the art will, however, realize that the angle of such slots may vary and that in a variant, these slots could not be parallel to one another thereby providing for a different type of adjustment. Also, although not illustrated, it is possible to conceive a helmet in which the front shell will comprise the longitudinal slots and the back shell will comprise the openings.

As shown more particularly in FIG. 2, the cam 32 is pivotally secured to the arms 34 of the clevis member 36 by using a metallic pin 43. The pin is inserted in openings 37 provided in the free end portion of the projecting arms. Advantageously, the openings 37 also define the orientation of the axis X'. The pin can easily be removed by the user. While such an embodiment is preferred, it would be possible to provide sockets into the arms 34 and pins on the cam so that one would snap within the other one. The person skilled in the art will however realize that other mechanisms that secure, preferably removably, the cam 32 to the arms 34 while allowing it to pivot may be available.

In the preferred embodiment, the side portions 24 of the front shells are provided with a recessed area 46 that receives the locking mechanism 30 so that the lever 33, when in a locking position, will not protrude substantially outwardly from the side portion of the helmet, as shown more particularly in FIGS. 6*b* and 7*b*.

Figure 8:
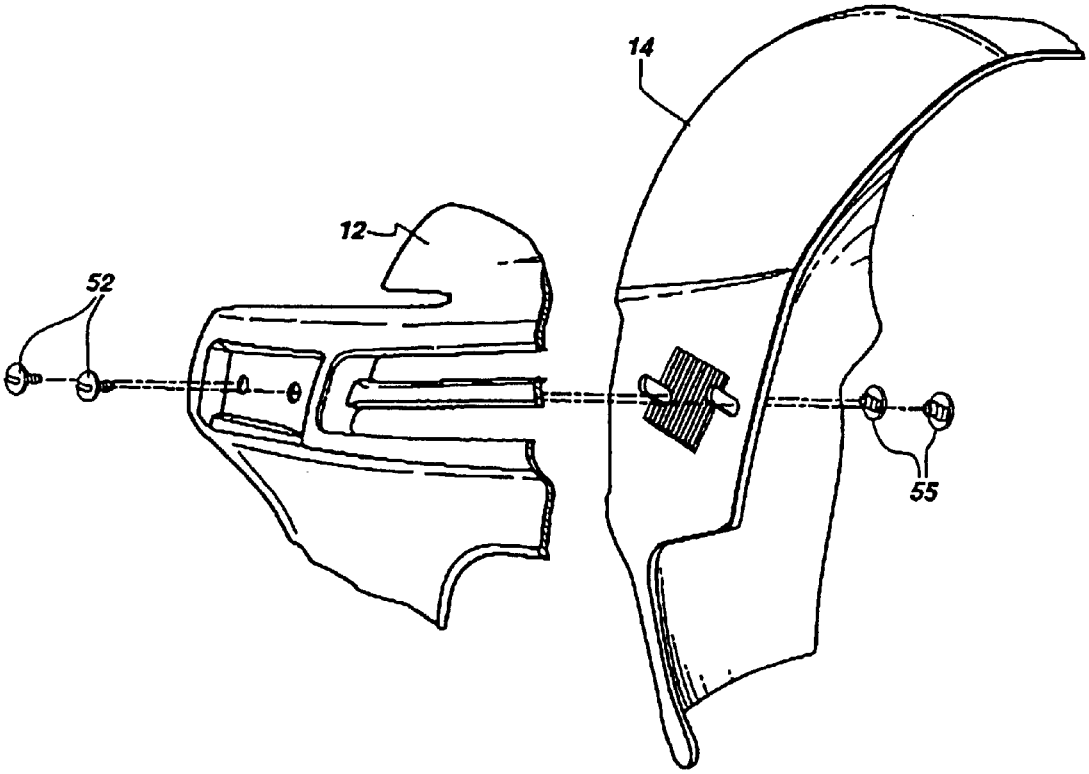
FIG. 8 is a partial exploded perspective view of the adjustable helmet wherein the locking mechanism has been replaced by conventional screws.

Since, in the preferred embodiment, the arms 34 of the clevis member 36 are of generally circular cross-section, the locking mechanism of the adjustable helmet of the present invention may easily and conveniently be replaced by conventional mounting screws. Thus, as shown in FIG. 8, the locking mechanism 30 may be replaced by a conventional locking mechanism comprising screws 52 and posts 55 such as the conventional stainless steel screw and post assembly usually found in hockey helmets. This is particularly advantageous if, for any reasons, the user decides to replace the locking mechanism so as to more or less permanently secure the front shell to the back shell in a selected position.

In such an embodiment, the adjustment of the helmet will be accomplished by loosening and tightening the screws as done in the prior art. Such an embodiment does not however form part of the present invention but is being referred to for illustrating the advantages of the locking mechanism of the present invention.

The above description of the preferred embodiments should not be interpreted in any limiting manner since variations and refinements are possible which are within the spirit and scope of the present invention. The scope of the invention is defined in the appended claims and their equivalents.

I claim:

1. An adjustable helmet comprising a front shell and a back shell moveable relative to one another, each of said front and back shells comprising a plurality of engaging members to allow said front shell to be secured to said back shell in a selected position, said helmet further comprising a locking mechanism having a cam being pivotable about a pivot axis to acquire either one of a locking position and an adjustment position, in said locking position, said cam exerting a force on said engaging members of either one of said front and back shells so that they interact with corresponding engaging members of the other one of said front and back shells to secure said front and back shells in a selected position, and in said adjustment position, said cam being pivoted about said axis so as to allow said front shell to move relative to said back shell, said pivot axis extending in a direction that is generally transverse relative to said engaging members, said axis being defined by the projecting arms of a clevis member, said arms extending through longitudinal slots located on either one of said front and back shells, said cam being pivotally connected to said arms.

2. An adjustable helmet according to claim 1, wherein said longitudinal slots extend upwardly and rearwardly from said front shell, whereby said front and back shells move angularly relative to one another.

3. An adjustable helmet according to claim 1, wherein said arms of said clevis have a generally-circular cross section.

4. An adjustable helmet according to claim 1, wherein said cam and said arms of said clevis member comprise openings therethrough and wherein said cam is pivotally connected to said arms by a removable locking pin.

5. An adjustable helmet according to claim 4, wherein said pivot axis is defined by said openings.

6. An adjustable helmet according to claim 1, wherein said arms comprise sockets and wherein said cam comprises pins extending through said sockets thereby pivotally connecting said cam to said arms.

7. An adjustable helmet according to claim 1, wherein said engaging members consist of parallelly extending teeth.

8. An adjustable helmet according to claim 1, wherein said cam comprises an integral lever for pivoting said cam.

9. An adjustable helmet according to claim 1, comprising a locking mechanism on each side thereof.

10. An adjustable helmet according to claim 1, wherein said cam comprises an integral lever for pivoting said cam.

11. An adjustable helmet according to claim 1, wherein the pivot axis extends in a direction that is substantially parallel to the side portions of the front shell.

* * * * *